United States Patent [19]

Foley et al.

[11] Patent Number: 4,554,230

[45] Date of Patent: Nov. 19, 1985

[54] ELECTROPHOTOGRAPHIC IMAGING MEMBER WITH INTERFACE LAYER

[75] Inventors: Geoffrey M. T. Foley, Fairport; Rudolph C. Enck, Webster, both of N.Y.

[73] Assignee: Xerox Corporation, Stamford, Conn.

[21] Appl. No.: 619,247

[22] Filed: Jun. 11, 1984

[51] Int. Cl.[4] ..... G03G 5/082; G03G 5/14

[52] U.S. Cl. ..... 430/58; 430/57; 430/63; 430/66; 430/126; 430/85; 430/86; 430/95

[58] Field of Search ..... 430/57, 58, 63, 66, 430/126

[56] References Cited

U.S. PATENT DOCUMENTS

| | | | |
|---|---|---|---|
| 2,901,348 | 8/1959 | Dessauer et al. . | |
| 2,962,376 | 11/1960 | Schaffert . | |
| 3,041,166 | 6/1962 | Bardeen . | |
| 3,467,548 | 9/1969 | Straughan . | |
| 3,635,705 | 1/1972 | Ciuffini . | |
| 3,639,120 | 2/1972 | Snelling . | |
| 3,655,377 | 4/1972 | Sechak . | |
| 3,803,541 | 8/1977 | Paris . | |
| 4,066,455 | 1/1978 | Mey et al. . | |
| 4,123,269 | 10/1978 | Von Hoene et al. . | |
| 4,170,476 | 10/1979 | Sadamatsu et al. . | |
| 4,226,929 | 10/1980 | Teshima et al. | 430/57 |
| 4,286,033 | 8/1981 | Neybart et al. | 430/58 |
| 4,297,424 | 10/1981 | Hewitt | 430/58 |
| 4,338,387 | 6/1982 | Hewitt | 430/58 |
| 4,426,435 | 1/1984 | Oka | 430/132 |
| 4,439,509 | 3/1984 | Schank | 430/132 |

FOREIGN PATENT DOCUMENTS

| | | | |
|---|---|---|---|
| 2616148 | 10/1976 | Fed. Rep. of Germany | 430/57 |
| 56-142537 | 11/1981 | Japan . | |
| 56-199701 | 12/1981 | Japan . | |
| 1530355 | 10/1978 | United Kingdom . | |
| 1578960 | 11/1980 | United Kingdom . | |

OTHER PUBLICATIONS

Tateishi et al., "Photoreceptor For LED Printer", E.C.C. Tech. Journ., vol. 31, No. 3, pp. 597–604 (1982).

Taniguchi et al., "A Highly Sensitive Charcogenide Photoconductor in a Near-Infrared Wavelength Region", J. Appl. Phys., 52 (12), Dec. 1981, pp. 7261–7269.

Photographic Science & Engineering, vol. 26, No. 5, Sep./Oct. 1982, pp. 239–244.

*Primary Examiner*—Roland E. Martin

*Attorney, Agent, or Firm*—Peter H. Kondo

[57] ABSTRACT

An electrophotographic imaging member is described comprising a substrate, a charge transport layer, a thin continuous interface layer consisting essentially of halogen doped selenium, and at least one selenium-tellurium alloy photoconductive charge generating layer. This electrophotographic imaging member may contain other layers such as a thin protective overcoating layer suitable for Carlson type imaging processes. An electrophotographic imaging process employing this electrophotographic imaging member is also described.

16 Claims, 2 Drawing Figures

ELECTROPHOTOGRAPHIC IMAGING MEMBER WITH INTERFACE LAYER

BACKGROUND OF THE INVENTION

This invention relates in general to an electrophotographic imaging system, and more specifically, to an electrophotographic imaging member containing an interface layer and a method of utilizing such device.

The formation and development of images on the imaging surfaces of electrophotographic imaging members by electrostatic means is well known. One of the most widely used processes being xerography described, for example, in U.S. Pat. No. 2,297,691. Numerous different types of photoreceptors can be used in the electrophotographic imaging process. Such electrophotographic imaging members may include inorganic materials, organic materials, and mixtures thereof. Electrophotographic imaging members may comprise contiguous layers in which one or more of the layers performs a charge generation function and the other layer forms a charge carrier transport function or may comprise a single layer which performs both the generation and transport functions. These electrophotographic imaging members may be coated with a protective overcoating to improve wear. For Carlson type electrophotographic imaging processes, the protective overcoating must allow the electrostatic charge initially deposited on the outer surface of the overcoating to form at the interface between the protective overcoating and the underlying photoconductive layer prior to repeating the next imaging cycle. Protective overcoatings may be of various organic and inorganic materials including resins, photoconductive materials and the like.

Electrophotographic imaging members based on amorphous selenium have been modified to improve panchromatic response, increase speed and to improve color copyability. These devices are typically based on alloys of selenium with tellurium. The selenium electrophotographic imaging members may be fabricated as single layer devices comprising a selenium-tellurium alloy layer which performs both charge generation and charge transport functions. The selenium electrophotographic imaging members may also contain multiple layers such as, for example, a selenium alloy transport layer and a contiguous selenium-tellurium alloy generator layer. These multiple layer electrophotographic imaging members containing a selenium-tellurium alloy generator layer are characterized by varying degrees of electrical instability during cycling. For example, multiple layer electrophotographic imaging members containing a selenium-tellurium alloy generator layer containing about 10 percent by weight tellurium and a selenium-arsenic alloy transport layer exhibit significant levels of residual cycle-up which may be further aggravated by cycle rate, thermal cycling at elevated temperatures and by undesirable interactions with lamps around the electrophotographic imaging member. Residual cycle up is the cumulative development of increasing levels of residual voltage with cycling. Residual voltage is that potential measured at the surface of the photoreceptor following photodischarge of the photoreceptor by high levels of light exposure. The residual voltage is a reflection of the existence of positive charge (in the case of a positive charging system) trapped in the bulk of the photoconductive layers or at interfaces between layers in the device. The rate of residual cycle up and its ultimate saturation value is generally observed to increase with increasing cycle rate. Equilibration of the photoreceptor at temperatures above room temperature either during photoreceptor storage or during machine operation also generally leads to a temporary enhancement of residual cycle up, both its rate of increase and its saturation value. Similarly, exposure of electrophotographic imaging members containing a selenium-tellurium alloy generator layer to radiation in the 600 to 700 nanometer range, e.g. light from tungsten or fluourescent room lights, during installation of the imaging member in a copier, duplicator or printer can cause a marked increase in cycle-up during subsequent use due to bulk absorbed radiation.

SUMMARY OF THE INVENTION

It is, therefore, an object of the present invention to provide an imaging system which overcomes the above-noted disadvantages.

It is another object of this invention to provide an electrophotographic imaging member which resists cycle-up under thermal cycling.

It is another object of this invention to provide an electrophotographic imaging member which resists cycle-up under rapid cycling.

It is another object of this invention to provide an electrophotographic imaging member which resists cycle-up during cycling after exposure to uniform illumination.

It is another object of this invention to provide an electrophotographic imaging member which resists cycle-up as a result of pre-exposure of the imaging member to uniform illumination.

It is still another object of the present invention to provide an electrophotographic imaging member which resists cycle down in background potential during cycling while having low residual cycle up.

The foregoing objects and others are accomplished in accordance with this invention by providing an electrophotographic imaging member comprising a substrate having an electrically conductive surface, a charge transport layer, a thin continuous interface layer consisting essentially of halogen doped selenium, and at least one selenium-tellurium alloy photoconductive charge generating layer. This electrophotographic imaging member may contain other layers such as a thin protective overcoating layer suitable for Carlson type imaging processes. This electrophotographic imaging member may be employed in a process involving depositing a substantially uniform positive electrostatic charge on the electrophotographic imaging member, exposing the electrophotographic imaging member to an imagewise pattern of electromagnetic radiation to which the selenium-tellurium alloy photoconductive charge generating layer is responsive whereby an electrostatic latent image is formed on the electrophotographic imaging member, developing the electrostatic image with electrostatically attractable toner particles to form a toner particle deposit in image configuration, transferring the toner particle deposit to a receiving member, and subjecting the electrophotographic imaging member to uniform light discharge. The process may be repeated numerous times in an automatic device.

The substrate may be opaque or substantially transparent and may comprise numerous suitable materials having the required mechanical properties. The entire substrate may comprise the same material as that in the electrically conductive surface or the electrically conductive surface may merely be a coating on the substrate. Any suitable electrically conductive material may be employed. Typical electrically conductive materials include, for example, aluminum, titanium, nickel, chromium, brass, stainless steel, copper, zinc, silver, tin, and the like. The conductive layer may vary in thickness over substantially wide ranges depending on the desired use of the electrophotoconductive member. Accordingly, the conductive layer may generally range in thickness from about 50 Angstrom units to many centimeters. When a flexible electrophotographic imaging member is desired, the thickness may be between about 100 Angstrom units to about 750 Angstrom units. The substrate may be of any other conventional material including organic and inorganic materials. Typical substrate materials include insulating non-conducting materials such as various resins known for this purpose including polyesters, polycarbonates, polyamides, polyurethanes, and the like. The coated or uncoated substrate may be flexible or rigid and may have any number of configurations such as, for example, a plate, a cylindrical drum, a scroll, an endless flexible belt, and the like.

In some cases, intermediate layers between the electrically conductive surface and subsequently applied layers may be desirable to improve adhesion. If such layers are utilized, they preferably have a dry thickness between about 0.1 micrometer to about 5 micrometers. Typical adhesive layers include film-forming polymers such as polyester, polyvinylbutyral, polyvinylpyrolidone, polyurethane, polymethylmethacrylate, and the like.

The charge transport material may be selected from the group consisting of pure selenium, selenium-arsenic alloy, selenium-arsenic-halogen alloy, and selenium-halogen. Preferably, the charge transport layer comprises a halogen doped selenium arsenic alloy. Generally, about 10 parts by weight per million to about 200 parts by weight per million of halogen is present in a halogen doped selenium arsenic alloy transport layer. If a halogen doped selenium charge transport layer free of arsenic is utilized, the halogen content should be less than about 20 parts by weight per million. Inclusion of high levels of halogen in a thick halogen doped selenium charge transport layer free of arsenic leads to excessive dark decay because dark decay is substantially a function of the total chlorine in a multilayer imaging member. Imaging members containing high levels of halogen in a thick halogen doped selenium charge transport layer free of arsenic are described, for example, in U.S. Pat. No. 3,635,705 to Ciuffini, U.S. Pat. No. 3,639,120 to Snelling, and Japanese Patent Publication No. J5 61 42-537 to Ricoh, published June 6, 1981. The imaging member of this invention requires incorporation of high levels of chlorine in a critical, distinct, separate, thin halogen doped selenium interface layer. Preferably, the charge transport layer comprises a halogen doped selenium arsenic alloy. Generally, the halogen doped selenium arsenic alloy charge transport layer comprises selenium between about 99.5 percent by weight to about 99.9 percent by weight and about 0.1 percent to about 0.5 percent by weight arsenic and between about 10 parts per million by weight to about 200 parts per million by weight of halogen, the latter halogen concentration being a nominal concentration. The expression "nominal halogen concentration" is defined as the halogen concentration in the alloy evaporated in the crucible. The thickness of the charge transport layer is generally between about 15 micrometers and about 75 micrometers. The expression "halogen materials" is intended to include fluorine, chlorine, bromine, and iodine. Chlorine is the preferred halogen because of the ease of handling and the stability of chlorine in the film (apparently due to lack of out diffusion).

The transport layer can be deposited by any suitable conventional technique, such as vacuum evaporation. Thus, a transport layer comprising a halogen doped selenium-arsenic alloy may be evaporated by conventional vacuum coating devices to form the desired thickness. The amount of alloy to be employed in the evaporation boats of the vacuum coater will depend on the specific coater configuration and other process variables to achieve the desired transport layer thickness. Chamber pressure during evaporation may be on the order of about $4\times10^{-5}$ torr. Evaporation is normally completed in about 15 to 25 minutes with the molten alloy temperature ranging from about 250° C. to about 325° C. Other times and temperatures and pressures outside these ranges may be used as well understood by those skilled in the art. It is generally desirable that the substrate temperature be maintained in the range of from about 50° C. to about 70° C. during deposition of the transport layer. Additional details for the preparation of transport layers are disclosed, for example, in U.S. Pat. No. 4,297,424 to H. Hewitt, the entire disclosure thereof being incorporated herein by reference.

The interface layer is positioned between the transport layer and the charge generating selenium-tellurium photoconductive layer. The interface layer material consists essentially of selenium and a nominal halogen concentration of about 50 parts by weight per million to about 2,000 parts by weight per million halogen material with the remainder comprising selenium. Minor additions of arsenic might be added but are relatively undesirable and may require additional halogen to compensate for this arsenic addition. The expression "nominal halogen concentration" is defined as the halogen concentration in the alloy evaporated in the crucible. The halogen concentration in the deposited interface layer will typically be somewhat less than that in the alloy evaporated in the crucible. In order to achieve optimal device properties, the actual halogen content in the final interface layer should be greater than about 35 parts by weight per million. Inclusion of high levels of halogen in thick halogen doped selenium layers free of arsenic leads to excessive dark decay because dark decay is substantially a function of the total halogen in a multilayer imaging member. Imaging members containing high levels of halogen in a thick halogen doped selenium charge transport layer free of arsenic are described, for example, in U.S. Pat. No. 3,635,705 to Ciuffini, U.S. Pat. No. 3,639,120 to Snelling, and Japanese Patent Publication No. J5 61 42-537 to Ricoh, published June 6, 1981. The imaging member of this invention incorporates high levels of halogen only in a critical, distinct, separate, thin halogen doped selenium interface layer. The expression "halogen" is intended to include fluorine, chlorine, bromine, and iodine. Chlorine is the preferred halogen because of the ease of handling and the stability of chlorine in the film (apparently due to lack of out diffusion). The interface layer material should consist essentially of selenium and an actual halogen concentration in the final interface layer of about 35 parts by weight per million to about 600 parts by weight per million halogen material. It has been found that dark decay of the electrophotographic imaging member increases with increasing interface layer thickness and with increasing halogen concentration. The improvement of this invention relating to residual cycle up is not observed in final interface layers at actual halogen concentrations of less than about 35 parts by weight per million. Dark decay becomes problematical at actual halogen concentrations in the final interface layer of greater than about 600 parts by weight per million.

The interface layer should be continuous and of substantially uniform thickness to ensure uniform electrophotographic properties over the entire imaging surface of the electrophotographic imaging member. If the interface layer is discontinuous, the final copy will show modulation of background and image densities dependent on photoreceptor history. The interface layer may be prepared by any suitable technique. Where the interface layer material is deposited by vacuum deposition techniques, the material to be deposited may be placed in a crucible in proximity to the substrate to be coated in a vacuum coater. The interface layer material may then be evaporated using an appropriate time/temperature program to form the interface layer on the substrate. A typical time/temperature program involves about 7 minutes evaporation during which the crucible temperature is increased from about 140° C. to about 315° C. with the substrate held at a temperature of about 65° C. Typical pressures include from about $10^{-4}$ torr to about $10^{-5}$ torr. The halogen doped selenium material employed in the interface layer may be efficiently deposited in conventional planetary coating systems by depositing the other selenium alloy layers prior to or subsequent to depositing the interface layer material without removing the substrate and without breaking the vacuum in the planetary coater.

The preferred thickness of the distinct continuous interface layer depends to some extent on the halogen concentration in the interface layer. For example, satisfactory results may be achieved with a continuous interface layer having a thickness less than about 3 micrometers for nominal halogen concentrations of about 100 parts per million by weight or having a thickness less than about 1 micrometer for nominal halogen concentrations of about 300 parts per million by weight. Generally, depending on the thickness of the interface layer, the interface layer may have a nominal halogen concentration of between about 50 parts per million by weight and about 2,000 parts per million by weight. It has been found that dark decay of the electrophotographic imaging member increases with increasing interface layer thickness and with increasing nominal halogen concentration. Optimum results are achieved with a continuous interface layer having a thickness between about 1 micrometer and about 3 micrometers at a nominal chlorine concentration between about 100 parts per million by weight and about 300 parts per million by weight.

By incorporation of the continuous interface layer of this invention between the transport layer and a generating layer, residual cycle-up due to cycle rate, thermal cycling at elevated temperatures and undesirable interactions with lamps and corotrons around the electrophotographic imaging member is markedly minimized in electrophotographic copiers, duplicators and printers.

Any suitable charge generating selenium-tellurium alloy photoconductive layer may be employed. Typical charge generating selenium-tellurium alloy photoconductive materials include selenium-tellurium alloys, selenium-tellurium alloys doped with halogen, selenium-tellurium-arsenic alloys, selenium-tellurium-arsenic-halogen alloys, and the like. The selenium-tellurium alloy may comprise between about 5 percent by weight and about 45 percent by weight tellurium, less than about 5 percent by weight arsenic and less than about 50 parts per million by weight halogen with the remainder being selenium.

The selenium-tellurium alloy generating layer can be prepared in one preferred embodiment by grinding the selenium-tellurium alloy, preparing pellets from the ground material, and evaporating the pellets in crucibles in a vacuum coater using a time/temperature crucible designed to minimize the fractionation of the alloy during evaporation. In a typical crucible evaporation program, the generating layer is formed in about 12 to about 15 minutes during which time the crucible temperature is increased from about 20° C. to about 385° C. Additional details for the preparation of generating layers are disclosed, for example, in U.S. Pat. No. 4,297,424 to H. Hewitt, the entire disclosure thereof being incorporated herein by reference.

Satisfactory results may be achieved with a selenium-tellurium alloy generating photoconductive layer having a thickness between about 1 micrometer and about 20 micrometers. Selenium-tellurium alloy generating layers having a thickness greater than about 20 micrometers are undesirable because preferential fractionation of alloy components occurs during vacuum evaporation. Thicknesses less than about 1 micrometer tend to wear too rapidly in automatic electrophotographic copiers, duplicators and printers if the generating layer serves as an outer exposed layer. However, generating layers as thin as 0.1 micrometer may be used if protected by an outer organic or inorganic overcoating layer. The overcoating layer may be a photoconductive layer or a non photoconductive layer. Optimum results are achieved with exposed generating layers having a thickness about 5 micrometers.

When, a protective overcoating is employed, it must allow the electrophotographic imaging member to be utilized in the conventional Carlson type electrophotographic imaging process in which the imaging member is normally uniformly charged once and then exposed to activating illumination in image configuration to form an electrostatic latent image. Thick insulating overcoatings do not allow the use of the conventional Carlson type electrophotographic imaging process, require multiple charging steps, and operate in an entirely different manner than the imaging member of this invention. Thus, the imaging member of this invention is entirely free of thick insulating overcoatings that prevent the use of the imaging member in the conventional Carlson type electrophotographic imaging process. Any suitable conventional electrostatic charge permeable continuous protective overcoating may be used which allows the positive electrostatic charge initially deposited on the outer surface of the overcoating to form at the interface between the electrostatic charge permeable continuous protective overcoating and the thermal hole generating selenium alloy photoconductive layer prior to repeating the next imaging cycle. Typical electrostatic charge permeable continuous protective overcoatings include, for example, thin polysiloxane overcoatings from ammonia cured cross-linkable siloxanol-colloidal silica hybrid material having at least one silicon bonded hydroxyl group per every three —SiO— units as described in U.S. Pat. No. 4,439,509 to R. Schank, finely divided metal oxide particles dispersed in a resin as described in U.S. Pat. No. 4,426,435 to K. Oka, thin photoconductive overcoatings and the like. The entire disclosures of these two patents are incorporated herein in their entirety. The thickness of the overcoatings generally ranges from about 0.5 micrometer to about 20 micrometers depending upon the specific electrostatic charge permeable continuous protective overcoating material employed.

BRIEF DESCRIPTION OF THE DRAWINGS

A more complete understanding of the process and device of the present invention can be achieved by reference to the accompanying drawings wherein.

Figure 1:
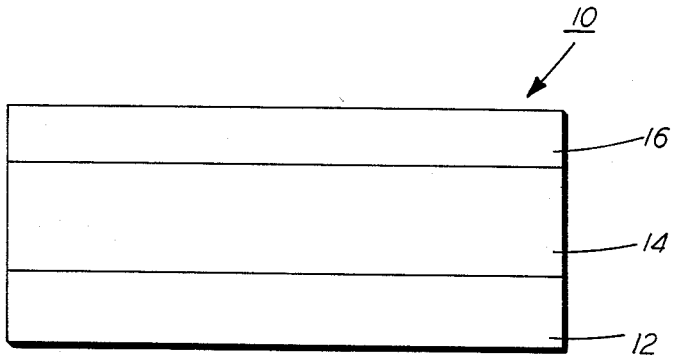
FIG. 1 graphically illustrates a typical prior art multilayered photoreceptor comprising a charge generating layer and a transport layer supported on a conductive substrate.

Refering to FIG. 1 an electrophotographic imaging member 10 of the prior art is illustrated comprising a substrate 12, a transport layer 14 comprising a halogen doped selenium-arsenic alloy layer and a generating layer 16 comprising an alloy of selenium-tellurium.

The substrate 12 may comprise any suitable material having the required mechanical properties. Typical substrates include aluminum, nickel and the like. The thickness of the substrate layer is dependent upon many factors including economic considerations, design of the device in which the electrophotographic imaging is to be used, and the like. Thus, the substrate may be of substantial thickness, for example, up to 200 mils, or of minimum thickness such as about 5 mils. Generally, the thickness of the substrate ranges from about 5 mils to about 200 mils. The substrate may be flexible or rigid and may have different configurations as described above.

The transport layer 14 comprises a halogen doped selenium arsenic alloy, however, an undoped alloy may also be used. The percent of selenium present in this alloy may range from about 99.5 percent to about 99.9 percent by weight and the percentage of arsenic present may range from about 0.1 percent by weight to about 0.5 percent by weight. The amount of halogen such as chlorine, fluorine, iodine or bromine present in the doped alloy layer may range from about 10 parts by weight per million to about 200 parts by weight per million with the preferred range being from about 20 parts by weight per million to about 100 parts by weight per million. The preferred halogen is chlorine. This layer generally ranges in thickness from about 15 micrometers to about 75 micrometers and preferably from about 25 micrometers to about 50 micrometers because of constraints imposed by the xerographic development system, constraints imposed by carrier transport limitations and for reasons of economics.

The charge generating layer 16 comprises charge generating selenium-tellurium alloy photoconductive material such as selenium-tellurium alloys, selenium-tellurium alloys doped with halogen, selenium-tellurium-arsenic alloys, selenium-tellurium-arsenic-halogen alloys, and the like. Excellent results may be achieved with alloys of selenium-tellurium. Generally, the selenium-tellurium alloy may comprise from about 55 percent by weight to about 95 percent by weight selenium and from about 5 percent by weight to about 45 percent by weight tellurium based on the total weight of the alloy. The thickness of the generator layer is generally less than about one micrometer when the tellurium content is about 40 percent. The selenium-tellurium alloy may also comprise other components such as less than about 5 percent by weight arsenic to minimize crystallization of the selenium and less than about 1000 parts by weight per million halogen.

Figure 2:
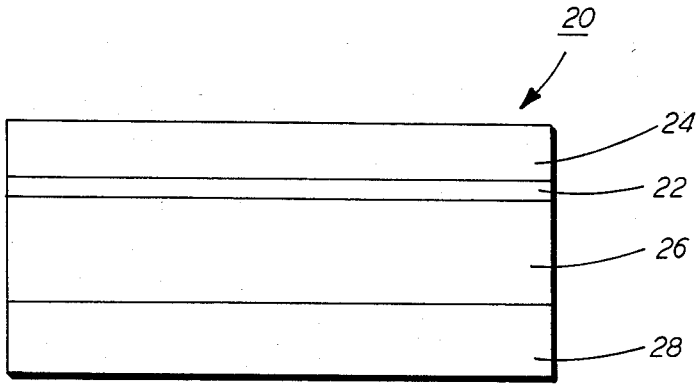
FIG. 2 graphically illustrates a multilayered photoreceptor of this invention comprising a charge generating layer, an interface layer and a hole transport layer supported on a conductive substrate.

Referring to FIG. 2, an electrophotographic imaging member 20 is depicted in which an interface layer 22 is sandwiched between a charge generating photoconductive layer 24 and a charge transport layer 26. The charge transport layer 26 is supported on a conductive layer 28. The principal difference between electrophotographic imaging member of FIG. 1 and that of FIG. 2 is the presence of the interface layer 22 shown in FIG. 2. The effects such as residual cycle-up due to cycle rate, thermal cycling at elevated temperatures and undesirable interactions with lamps and corotrons around the electrophotographic imaging member following repeated uniform charging, imagewise exposure, development, transfer, erase and cleaning cycles are significantly different between the electrophotographic imaging member shown in FIG. 1 and the electrophotographic imaging member shown in FIG. 2. This difference is described in greater detail in the working examples below.

Any suitable development technique may be utilized to develop the electrostatic latent image on the electrophotographic imaging member of this invention. Well known electrophotographic development techniques include, for example, cascade development, magnetic brush development, liquid development, powder cloud development and the like. The deposited toner image may be transferred to a receiving member by any suitable conventional transfer technique and affixed to the receiving member by any suitable well known fusing technique. While it is preferable to develop an electrostatic latent image with toner particles, the electrostatic latent image may be employed in a host of other ways such as, for example, "reading" the electrostatic latent image with an electrostatic scanning system. Cleaning of the photoreceptor to remove any residual toner particles remaining after transfer may be effected by any suitable conventional cleaning technique such as brush cleaning, blade cleaning, web cleaning and the like.

Erasure of the electrostatic latent image may be accomplished by any suitable conventional technique. Typical conventional erase techniques include AC corona discharge, negative corona discharge, illumination from a light source, contact with a grounded conductive brush, and combinations thereof. However, the imaging member of this invention is particularly suitable for imaging systems in which the imaging member is exposed to a source of light having a wavelength to which the generator layer is sensitive, e.g. pretransfer light, erase light, fuser radiation leakage and the like which discharges the imaging member to residual potential each copy cycle. If discharge to residual potential by exposure to light occurs during each copy cycle, residual cycle-up is greatly increased with multilayer selenium-tellurium imaging members that do not contain the interface layer of this invention compared to residual cycle-up with multilayer selenium-tellurium imaging members that contain the interface layer of this invention. For example, the residual voltage after 500 cycles of a selenium-tellurium alloy electrophotographic imaging member without the interface layer of this invention can be as much as 3,900 percent greater than a selenium-tellurium alloy electrophotographic imaging member with the interface layer of this invention.

Residual cycle-up due to cycle rate, thermal cycling at elevated temperatures and undesirable interactions with lamps and fusers around the electrophotographic imaging member is highly undesirable in precision, high speed electrophotographic copiers, duplicators and printers because such cycle up ultimately appears as toner development in background areas of the document original and therefore constitutes a "dirty" copy.

The invention will now be described in detail with respect to specific preferred embodiments thereof, it being understood that these examples are intended to be illustrative only and that the invention is not intended to be limited to the materials, conditions, process parameters and the like recited herein. All parts and percentages are by weight unless otherwise indicated.

EXAMPLE I

A control electrophotographic imaging member was prepared by evaporating at a temperature of about 330° C. from a stainless steel crucible at a pressure of about $2\times10^{-5}$ torr onto an aluminum cylinder having a diameter of about 8.4 centimeters maintained at a temperature of about 60° C. a chlorine doped selenium-arsenic alloy to form a chlorine doped selenium-arsenic charge transport layer having a thickness of about 54 micrometers and containing about 0.5 percent by weight arsenic, about 99.5 percent by weight selenium and about 20 parts per million by weight chlorine. This coated substrate was then coated by evaporating at a temperature of about 320° C. from a stainless steel crucible at a pressure of about $2\times10^{-5}$ torr a selenium-tellurium alloy to form a charge generating selenium photoconductive layer having a thickness of about 5 micrometers and containing about 10 percent by weight tellurium and 90 percent by weight selenium. The resulting electrophotographic imaging member was tested in a test fixture which cycled the imaging member at 11.0 cm/sec. The imaging member was first charged to a positive potential of abut 900 volts and exposed to an exposure source having its spectral output in the blue region of the visible spectrum (about 470 nm) to reduce the potential to about 200 volts. The imaging member was then erased by means of an electroluminescent strip with a peak output in the green region of the visible spectrum. This process was repeated 500 times in a room temperature environment and the residual voltage cycle up at the end of the 500th cycle was determined by an electrostatic voltmeter. The residual voltage cycle up on this control imaging member was 160 volts.

EXAMPLE II

The procedure of Example I was repeated except that a continuous interface layer was deposited onto the transport layer prior to deposition of the generator layer. The continuous interface layer was applied by evaporating a chlorine doped amorphous selenium material containing 200 parts by weight per million of chlorine (concentration prior to evaporation) at a temperature of about 315° C. from a stainless steel crucible at a pressure of about $2\times10^{-5}$ torr onto a transport layer having the composition and thickness described in Example I maintained at a temperature of about 60° C. to form a continuous interface layer having a thickness of about 1 micrometer and having a chlorine concentration of about 150 parts by weight per million. A generator layer having the composition and thickness described in Example I was applied using the same procedures as in Example I. This photoreceptor containing the continuous interface layer was then subjected to 500 imaging cycles as described in Example I. The residual voltage cycle up after the 500th cycle was 4 volts. Thus, the residual voltage cycle up of the photoreceptor of control Example I was 3,900 percent greater than the residual voltage cycle up of this Example.

EXAMPLE III

The procedure of Example I was repeated except that an identical control electrophotographic imaging member was first subjected to a step heating cycle in which the imaging member was held at 115° F. for 15 hours, returned to room temperature and thereafter cycled as in Example I but for only 100 cycles. The residual voltage cycle up enhancement for the control electrophotographic imaging member was 97 volts higher at 100 cycles than for the same photoreceptor at 100 cycles prior to step heating.

EXAMPLE IV

The procedure of Example II was repeated except that the electrophotographic imaging member was subjected to a step heating cycle in which the imaging member was held at 115° F. for 15 hours, returned to room temperature and thereafter cycled as in Example II but for only 100 cycles. The residual voltage cycle up enhancement for the electrophotographic imaging member was 7 volts higher at 100 cycles than for the same photoreceptor prior to step heating. Thus, the enhancement of residual cycle up due to step heating was 1286 percent greater for the control electrophotographic imaging member described in Example III than the photoreceptor of this Example.

EXAMPLE V

The procedure of Example I was repeated except that an identical electrophotographic imaging member was pre-exposed to monochromatic light at 670 mm at a light intensity of about 30 microwatts/cm$^2$ for a period of 10 minutes. The electrophotographic imaging member was then cycled for 50 cycles according to the procedure of Example I. The enhancement of residual cycle up due to pre-exposure (determined by comparing the residual cycle up for the same number of cycles prior to pre-exposure) was 265 volts for this control photoreceptor.

EXAMPLE VI

The procedure of Example II was repeated except that an identical electrophotographic imaging member was pre-exposed to monochromatic light at 670 micrometers having an intensity identical with that of Example V for an exposure time of 10 minutes. The electrophotographic imaging member was then cycled for 50 cycles according to the procedure of Example II. The enhancement of residual cycle up due to pre-exposure (determined as for Example V) was 22 volts for this electrophotographic imaging member. Thus, the enhancement of residual cycle up due to pre-exposure was 1,105 percent higher for the control than for the electrophotographic imaging member of this Example.

EXAMPLE VII

The procedure of Example I was repeated except that a continuous interface layer was deposited onto the transport layer prior to deposition of the generator layer. The continuous interface layer was applied by evaporating a chlorine doped amorphous selenium material containing 50 parts by weight per million of chlorine (concentration prior to evaporation) at a temperature of about 315° C. from a stainless steel crucible at a pressure of about $2\times10^{-5}$ torr onto a transport layer having the composition and thickness described in Example I maintained at a temperature of about 60° C. to form a continuous interface layer having a thickness of about 1 micrometer and having a chlorine concentration of about 40 parts by weight per million. A generator layer having the composition and thickness described in Example I was applied using the same procedures as in Example I. The residual cycle up after the 500th cycle was 4 volts. Thus the residual voltage cycle up of control Example I was 3,900 percent greater than the residual voltage cycle up of this Example.

EXAMPLE VIII

The procedure of Example I was repeated except that a continuous interface layer was deposited onto the transport layer prior to deposition of the generator layer. The continuous interface layer was applied by evaporating a chlorine doped amorphous selenium material containing 800 parts by weight per million of chlorine (concentration prior to evaporation) at a temperature of about 315° C. from a stainless steel crucible at a pressure of about $2\times10^{-5}$ torr onto a transport layer having the composition and thickness described in Example I maintained at a temperature of about 60° C. to form a continuous interface layer having a thickness of about 1 micrometer and having a chlorine concentration of about 300 parts by weight per million. A generator layer having the composition and thickness described in Example I was applied using the same procedures as in Example I. The residual voltage cycle up after the 500th cycle was 7 volts. Thus, the residual voltage cycle up of the photoreceptor of control Example I was 2,186 percent greater than the residual voltage cycle up of this Example.

EXAMPLE IX

The procedure of Example I was repeated except that a continuous interface layer was deposited onto the transport layer prior to deposition of the generator layer. The continuous interface layer was applied by evaporating an amorphous high purity selenium layer at a temperature of about 315° C. from a stainless steel crucible at a pressure of about $2\times10^{-5}$ torr onto a transport layer having the composition and thickness described in Example I maintained at a temperature of about 60° C. to form a continuous interface layer having a thickness of about 1 micrometer. A generator layer having the composition and thickness described in Example I was applied using the same procedures as in Example I. The residual cycle up after the 100th cycle was 96 volts. This high level of residual cycle up is consistent with the lack of chlorine in the interface layer.

Although the invention has been described with reference to specific preferred embodiments, it is not intended to be limited thereto, rather those skilled in the art will recognize that variations and modifications may be made therein which are within the spirit of the invention and within the scope of the claims.

We claim:

1. An electrophotographic imaging member comprising a substrate, a charge transport layer comprising selenium, said charge transport layer containing less than about 20 parts per million by weight halogen, a thin continuous interface layer of halogen doped selenium overlying said charge transport layer, said interface layer of halogen doped selenium consisting essentially of selenium and about 35 parts per million to about 600 parts per million by weight halogen, and at least one selenium-tellurium alloy photoconductive charge generating layer overlying said thin continuous interface layer.

2. An electrophotographic imaging member according to claim 1 wherein said halogen is chlorine.

3. An electrophotographic imaging member according to claim 1 wherein said thin continuous interface layer has a thickness of less than about 3 micrometers.

4. An electrophotographic imaging member according to claim 1 wherein said selenium-tellurium alloy photoconductive charge generating layer comprises alloys selected from the group consisting of selenium-tellurium and selenium-tellurium-arsenic.

5. An electrophotographic imaging member according to claim 4 wherein said alloy of selenium-tellurium comprises up to about 5 percent by weight arsenic based on the total weight of said alloy.

6. An electrophotographic imaging member according to claim 4 wherein said selenium-tellurium alloy photoconductive charge generating layer is doped with less than about 5 parts per million by weight halogen.

7. An electrophotographic imaging member according to claim 4 wherein said alloy of selenium-tellurium comprises about 5 percent by weight to about 45 percent by weight tellurium based on the total weight of said alloy.

8. An electrophotographic imaging member according to claim 4 wherein said alloy photoconductive charge generating layer has a thickness between about 0.1 micrometer and about 20 micrometers.

9. An electrophotographic imaging member according to claim 1 wherein said hole transport layer comprises a halogen doped selenium arsenic alloy comprising about 99.5 percent to about 99.9 percent by weight selenium, about 0.5 percent to about 0.1 percent by weight arsenic and about 10 perts per million to about 200 parts per million by weight halogen.

10. An electrophotographic imaging member according to claim 3 wherein said hole transport layer has a thickness of between about 15 micrometers and about 75 micrometers.

11. An electrophotographic imaging member according to claim 10 wherein said thin continuous interface layer has a thickness of less than about 3 micrometers.

12. An electrophotographic imaging process comprising providing an electrophotographic imaging member comprising a substrate, a charge transport layer comprising selenium, said charge transport layer containing less than about 20 parts per million by weight halogen, a thin continuous interface layer of halogen doped selenium overlying said charge transport layer, said interface layer of halogen doped selenium consisting essentially of selenium and about 35 parts per million to about 600 parts per million by weight halogen, and at least one selenium-tellurium alloy photoconductive charge generating layer overlying said thin continuous interface layer, depositing a substantially uniform positive electrostatic charge on said electrophotographic imaging member, exposing said electrophotographic imaging member to an imagewise pattern of electromagnetic radiation to which said selenium-tellurium alloy photoconductive charge generating layer is responsive whereby an electrostatic latent image corresponding to said imagewise pattern is formed on said electrophotographic imaging member, developing said electrostatic latent image with electrostatically attractable toner particles to form a toner particle deposit corresponding to said imagewise pattern, transferring said toner particle deposit to a receiving member, and subjecting said electrophotographic imaging member to light discharge.

13. An electrophotographic imaging process according to claim 12 wherein said halogen is chlorine.

14. An electrophotographic imaging process according to claim 12 wherein said thin continuous interface layer has a thickness of less than about 3 micrometers.

15. An electrophotographic imaging process according to claim 12 wherein said imaging process is repeated at least once.

16. An electrophotographic imaging process according to claim 12 wherein said selenium-tellurium alloy photoconductive charge generating layer is overcoated with an electrostatic charge permeable continuous protective overcoating which allows said uniform positive electrostatic charge to form at the interface between said electrostatic charge permeable continuous protective overcoating and said selenium-tellurium alloy photoconductive charge generating layer prior to repeating said imaging process.

* * * * *